United States Patent [19]

Christian

[11] 4,421,092

[45] Dec. 20, 1983

[54] ARCHERY ARROW SUPPORT DEVICE

[76] Inventor: Sherrell G. Christian, Rte. 1, Box 72-L, Tickfaw, La. 70466

[21] Appl. No.: 295,383

[22] Filed: Aug. 24, 1981

[51] Int. Cl.[3] ..... F41B 5/00

[52] U.S. Cl. ..... 124/41 A

[58] Field of Search ..... 124/24 R, 41 A, 88, 124/86

[56] References Cited

U.S. PATENT DOCUMENTS

| | | | |
|---|---|---|---|
| 1,847,593 | 3/1932 | Cameron . | |
| 2,665,679 | 1/1954 | Gaskell . | |
| 2,743,716 | 5/1956 | Wendt . | |
| 3,059,631 | 10/1962 | Yasho . | |
| 3,285,327 | 11/1966 | Wolfe . | |
| 3,372,686 | 3/1968 | Losh . | |
| 3,482,563 | 12/1969 | Pint | 124/41 A X |
| 3,494,347 | 2/1970 | Saunders . | |
| 3,698,375 | 10/1972 | Brougham . | |
| 3,828,757 | 8/1974 | Finlay . | |
| 3,871,352 | 3/1975 | Stanislawski et al. . | |
| 3,890,951 | 6/1975 | Jennings et al. | 124/41 A |
| 3,918,428 | 11/1975 | Wilson et al. . | |
| 4,324,221 | 4/1982 | Peck | 124/24 R |

*Primary Examiner*—Richard C. Pinkham

*Assistant Examiner*—William R. Browne

*Attorney, Agent, or Firm*—David L. Ray

[57] ABSTRACT

An improved arrow support device to be used on archery bows, including a pair of elongated, generally non-resilient arrow support members, rigidly attached to a pivotable yoke member. The arrow support members are bound by the yoke member and oriented in relation to one another so that the arrow shaft contacting outer tips of the arrow support members present no obstruction to the passage of an arrow with fletching, upon discharge of a shot. The yoke member pivots about an axis oriented so that the arrow contacting surfaces of the arrow support members can move downwardly at an angle inclined toward the surface of the bow sight window. The yoke member is held against a stop by spring tension. When the arrow bends due to the initial impact of release, the yoke assembly pivots against the spring tension which will return the yoke assembly to the stop when the initial bend of the arrow shaft passes through the zero point of the "S" curve. The yoke assembly is pivotally attachable to a pivot frame assembly which is attachable to a bow. This provides an improved arrow support device having one movable part, to move alternatingly in a lateral plane of an axis of intended arrow flight.

2 Claims, 9 Drawing Figures

ARCHERY ARROW SUPPORT DEVICE

BACKGROUND OF THE INVENTION

1. Field of the Invention

The present invention generally involves those devices used in archery to support the arrow on the side of the bow during target shooting and hunting conditions. More specifically, the invention relates to an archery arrow support device using a rigidly-constructed, spring-loaded yoke assembly as the supporting member.

2. Description of the Prior Art

Prior art has recognized the problems inherent in the drawing and releasing of a bowstring without causing inconsistent vertical and lateral displacement forces to be imposed on the arrow which influence it to assume inconsistent bending patterns on impact of release and during acceleration out of the bow. Vertical displacement force is intentionally achieved by nocking the arrow somewhat above the horizontal center line of force, influencing the arrow to assume a downward bend at the impact of release. Unintentional vertical displacement forces are present due to inconsistent release problems, variations in pressures in the archer's bow arm and hand, and unavoidable imbalances in the bow limbs, all of which are transferred to the bowstring and to the arrow nocked thereon. Lateral displacement force is generated by lateral displacement of the bowstring at the instant of release, the finger style of shooting causing the greatest degree of displacement, and modern mechanical release devices causing little or no lateral displacement.

Lateral displacement of the bowstring is also caused by any lateral movement of the archer's bow hand, wrist, arm, or body or by torque built into the bow during manufacture due to inconsistency in alignment and limb balance. Lateral displacement of the accelerating arrow shaft can be caused by interaction of vertical and lateral arrow-supporting members of the arrow support system. Prior art recognizes that any lateral displacement is undesirable using cushioning devices to compensate for it. Other devices are used to compensate for variations in vertical displacement, assuming that lateral displacement is not present when using mechanical release devices. The present invention holds that both vertical and lateral displacement forces may be present during release and acceleration of the shot, and that it is apparent that if two displacement forces—one in the vertical direction and one in the lateral direction—act in combination on the arrow during release and acceleration, a net force is imparted to the arrow which will influence the arrow to bend along a theoretical net line of force. It is also apparent that if the vertical and lateral displacement forces are of inconsistent amplitude, the degree of difference between the values of the two forces will produce radial inconsistency of the theoretical net line of force, causing the arrow to bend and fly accordingly.

An arrow support device capable of minimizing these unavoidable variations in vertical and lateral displacement by averaging the radial variations of the net force with a non-variable reference would be far more effective than devices now in use. The present invention is directed towards providing this capability.

SUMMARY OF THE INVENTION

The present invention is directed towards providing an improved arrow support device having one movable assembly comprising: two or more arrow support members of substantially non-resilient material bound together by a pivotable spring-loaded yoke for movement along a plane perpendicular to the pivot axis of the yoke. The yoke is pivotally mounted to a rigid frame which is rigidly attachable to a bow, providing an arrow-supporting device of strong construction which is highly reliable in use under all shooting conditions and is highly resistant to wear, generally requiring a one-time adjustment for a given bow (bow weight and arrow size). The relatively high mechanical strength of the critical components of this device assures high reliability of precise adjustments.

It is another object of this invention to provide an improved arrow support device which will present no obstruction to the passage of an arrow with laterally protruding fletching.

It is yet another object of this invention to provide an improved arrow support device which will prevent the arrow from falling off the arrow support means when the archer vertically displaces or swings his bow arm during or after the draw to follow a moving target.

It is yet another object of this invention to provide an improved arrow support device which facilitates fast loading in that the nocked arrow can be placed anywhere in the sight window above the arrow support device and will fall into the cradle formed by the arrow support members of the yoke when the bow is raised to the shooting position.

It is yet another object of this invention to provide an improved arrow support device which will handle the arrow with a very light, adjustable touch of the tips of the arrow support members, minimizing damage to the shafting of the arrow, providing quiet passage through the rest, and preventing excessive wearing of the arrow-contacting surface.

It is yet another object of this invention to provide an improved arrow support device which simplifies the bow-tuning process, since most critical adjustments of the rest can be measured or taken from the bow manufacturers' specification charts and can be made before an arrow is shot.

It is another object of this invention to provide an improved arrow support device which has the capability of minimizing inconsistent downwardly directed vertical and lateral displacement forces which cause inconsistent bending of the arrow in the shooting process.

It is yet another object of this invention to provide an improved arrow support device which has the capability of minimizing the effects of inconsistent bowhand position and pressures, providing an added degree of forgiveness.

BRIEF DESCRIPTION OF THE DRAWINGS

FIG. 5 is a fragmentary sectional view of the pivot clamp taken along the line 5—5 of FIG. 3;

FIG. 6 is a vertical sectional view of the invention taken along the line 6—6 of FIG. 1;

DETAILED DESCRIPTION OF THE PREFERRED EMBODIMENT

Figure 1:
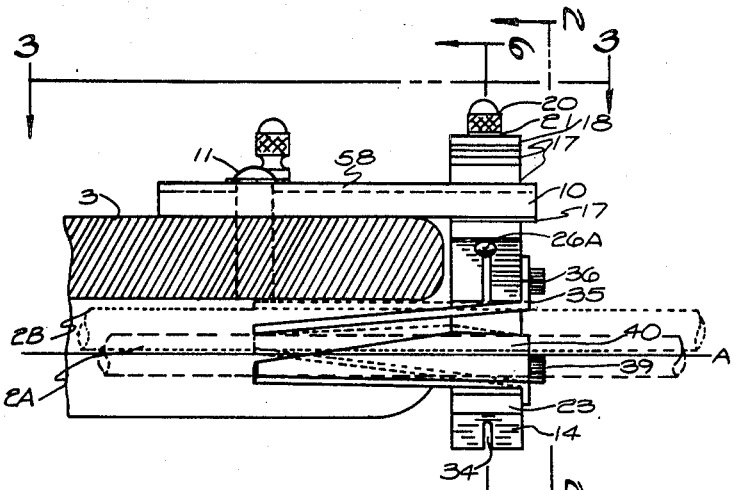
FIG. 1 is a fragmentary top plan view of the invention, taken on the line 1—1 of FIG. 3.

A description of the forces imparted upon an arrow by a bow and the archer shall first be described with reference to FIGS. 7, 8, and 9.

A bow generally indicated at 3 indicates a handle provided with a vertical support member 7 and a lateral support member 9. A bowstring 4 is depicted in FIG. 7 and FIG. 8 at its full draw position with an arrow 2 nocked thereon. It is indicated in FIG. 7 that arrow 2 is nocked on bowstring 4 at a traditional distance above the center line of force F. Line F is in relation to bow 3 and is always vertically and laterally stable relative to bowstring 4 with arrow 2 nocked thereon. The point end of arrow 2 is maintained stable relative to line F by support members 7 and 9.

Figure 7:
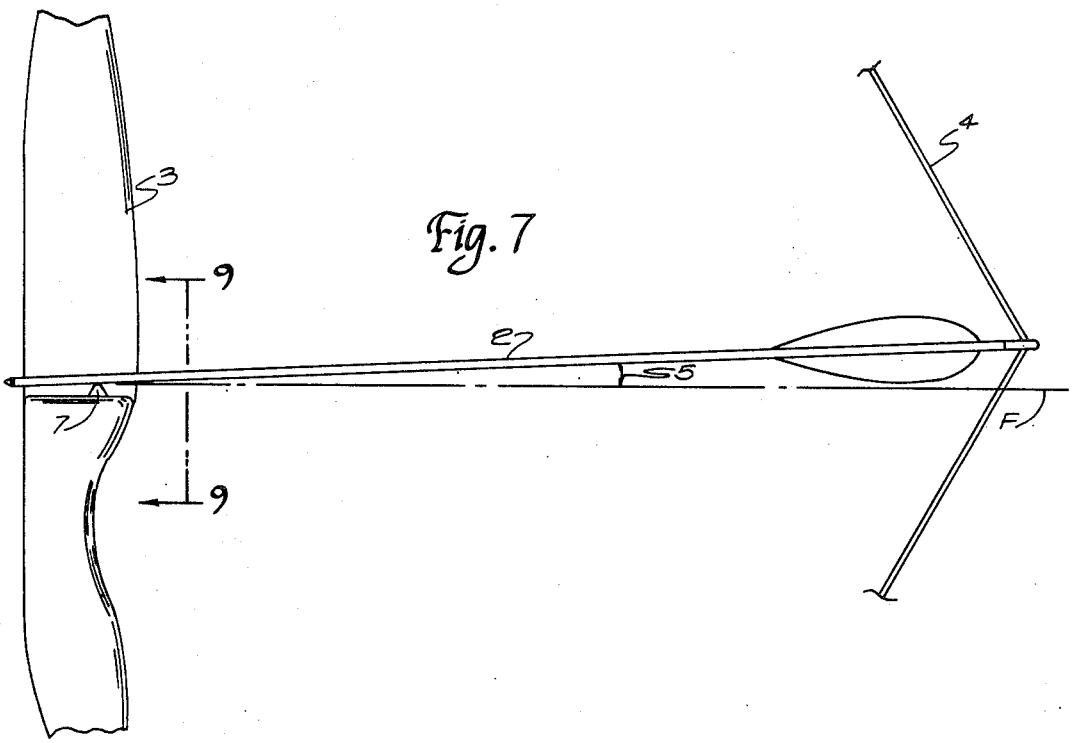
FIG. 7 is a fragmentary side elevational view of the manner in which an arrow is traditionally nocked on a bowstring held at full draw.

With reference to the conditions set up in FIG. 7, the primary force serving to propel arrow 2 from bow 3 is that force imparted by the pull or draw weight of the bow limbs (not shown) and transmitted to arrow 2 through bowstring 4.

This primary force is directed along the center line of force indicated by F. Because of the high length-to-diameter ratio of arrow 2 when the nock end of arrow 2 is displaced away from line F as depicted by angle 5 in FIG. 7, the primary force imposed thereon at the moment of release causes arrow 2 to bend downwardly, therefore directing the point thereof to assume a path inclined in the vertical direction. Having nocked arrow 2 above the center line of force F as indicated in FIG. 7, a vertical displacement force was generated at the moment of release to influence arrow 2 to bend downwardly. In the absence of this force, arrow 2 would bend in an unpredictable and erratic manner.

Figure 8:
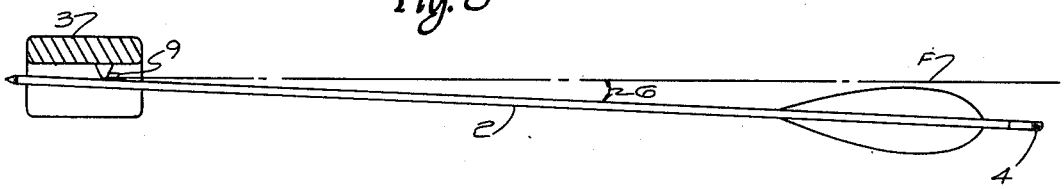
FIG. 8 is a fragmentary top sectional view taken along the line 8—8 of FIG. 9, depicting the lateral displacement of an arrow.
Figure 9:
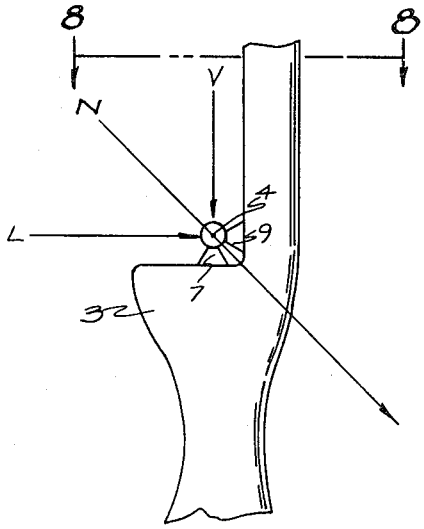
FIG. 9 is an enlarged fragmentary vertical sectional view taken along the line 9—9 of FIG. 7, depicting the lateral displacement forces acting upon the arrow upon release of the bowstring.

FIG. 8 is a view of bow handle 3 taken on the line 8—8 of FIG. 9. As indicated, bowstring 4 with arrow 2 nocked thereon has been displaced laterally away from force line F, indicated by angle 6. This lateral displacement of bowstring 4 will initiate lateral displacement force upon impact of release to influence arrow 2 to bend toward force line F or inwardly toward bow 3, causing the point end of arrow 2 to assume a path inclined laterally away from bow 3. When the fingers of an archer are utilized for drawing and releasing bowstring 4, there inevitably exists a lateral shifting of bowstring 4 with arrow 2 nocked thereon, due to the rolling of bowstring 4 off the fingers of the archer. This shifting is in either the left or right direction, depending upon whether a left-handed or right-handed bow is used.

Assuming that a right-handed bow is being utilized as depicted in FIGS. 7, 8, and 9, this lateral displacement force is indicated by arrow L in FIG. 9 and is opposed by lateral arrow support member 9. Vertical displacement force is indicated by arrow V in FIG. 9 and is opposed by vertical support member 7. The vertical displacement angle 5 of FIG. 7 and the lateral displacement angle 6 of FIG. 8 will initiate displacement forces upon impact of release of a value relative to the degree of displacement. If the vertical and lateral displacement forces are equal, then the resultant effects will provide a theoretical net force in the direction indicated by arrow N in FIG. 9.

Depending upon the degree of difference between the values of the lateral and vertical displacement, net force N may be oriented anywhere within the 90 degree quandrant represented by arrows L and V. As depicted in FIGS. 7 and 8, the moment that bowstring 4 is released from full draw, equal vertical and lateral displacement forces imposed by bow 3 immediately cause arrow 2 to bend in a curve directed in a path downwardly at an angle inclined toward the side of bow 3 and along net force line N of FIG. 9. The resiliency inherent in arrow 2 will cause an immediate tendency to recover from this initial bend, and arrow 2 will overcompensate, rebounding away from support members 7 and 9 to bend into a curved path directed outwardly at an angle inclined away from bow 3 along force line N to form a bending pattern traditionally called the S curve. The second bend of the S curve is both the result and the inverse of the first bend.

The embodiment of the improved arrow support device shown in this disclosure holds that lateral and vertical displacement forces can be adjusted so they are equal, giving a net displacement force which bisects the 90 degree quandrant formed by arrows V and L in FIG. 9. In making this adjustment, the archer traditionally sets the nocking point above the center line of force by an amount equal to the combined lateral displacement of his shooting style and any built-in torque in the bow. This is the accepted way that a bow is tuned, whether or not the archer is aware of what he is actually doing. The present invention does not alter this tuning procedure, but simply operates along the resultant net line of force, making the above tuning procedure extremely simple.

A preferred embodiment of the present invention shall now be described with reference to FIGS. 1–6.

Figure 2:
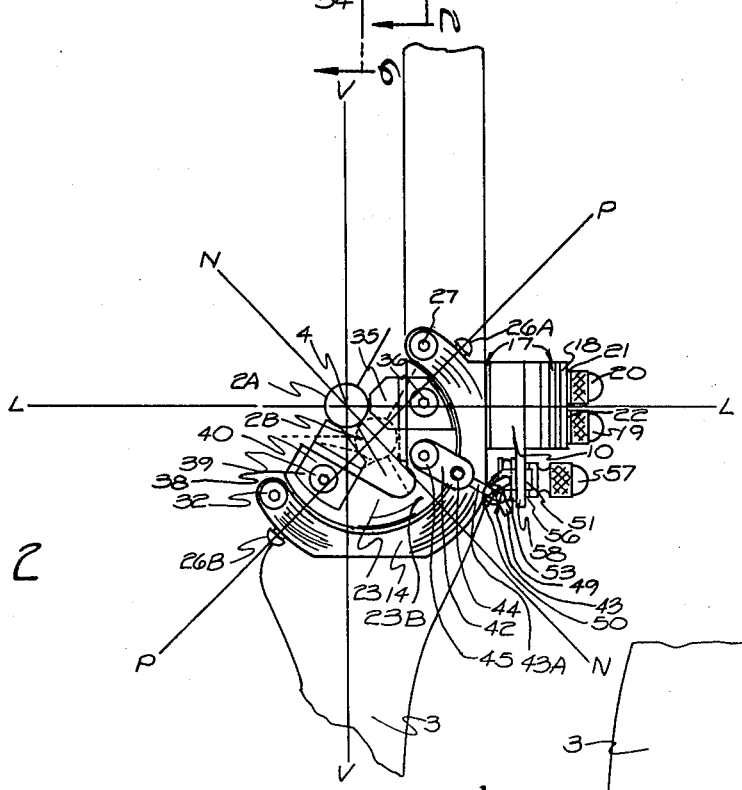
FIG. 2 is a vertical sectional view taken along the line 2—2 of FIG. 1.
Figure 4:
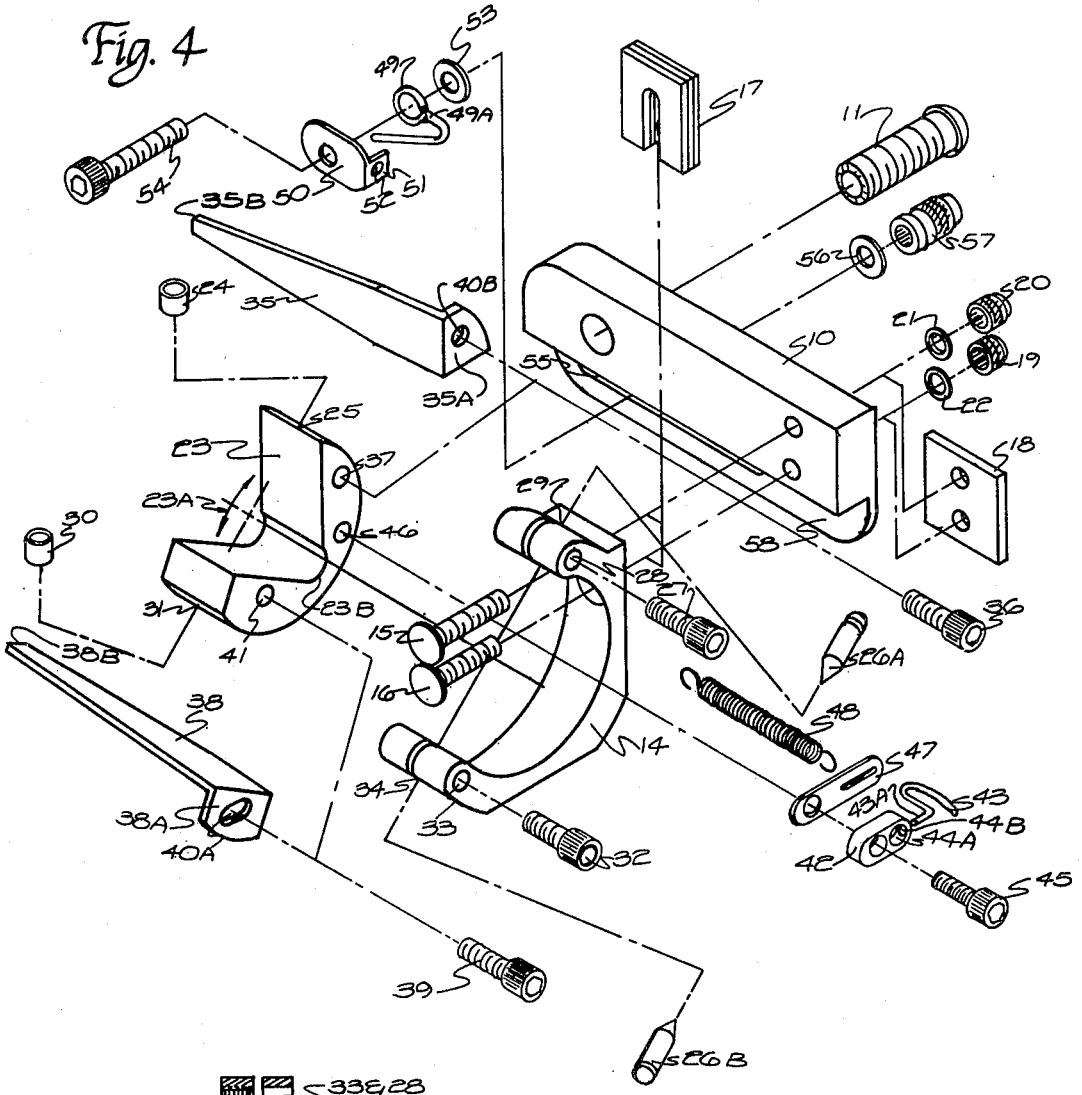
FIG. 4 is an exploded view of the invention.

The arrow support device includes a pair of elongated, generally non-resilient arrow support members 35 and 38, adapted with mounting flanges 35A and 38A having apertures 40A and 40B, disposed therein as depicted in FIG. 4, for the purpose of mounting to yoke 23. The mounting is accomplished by suitable means, such as screws 36 and 39 and threaded apertures 37 and 41, shown in FIGS. 1, 2 and 4. Arrow support members 35 and 38 and yoke 23 are intended to be as non-yielding as materials, space limitations, and weight considerations will allow, providing in combination an arrow support-yoke assembly, which moves as a unit as depicted in FIGS. 1 and 2. Elongated aperture 40A disposed in the mounting flange 38B of arrow support member 38 shown in FIG. 4 provides lateral adjustment of arrow support member 38 to accomodate various sizes of arrow shafts. The outer tips of arrow support members 35 and 38 can be provided with a cushion material to minimize noise for hunting purposes.

Pivot bearings 24 and 30 are pressed into pivot-bearing sockets 25 and 31 of yoke 23 as depicted in FIG. 6. Yoke 23, with arrow support members 35 and 38 attached thereto, is secured in pivot frame 14 by mating conical pivot members 26A and 26B with said pressed-in pivot bearings 24 and 30.

Yoke 23 can be centered in pivot frame member 14 by adjusting the position of conical pivot members 26A and 26B in apertures 29 and 34. When the yoke is satisfactorily centered, conical pivot members 26A and 26B are then clamped in place by screws 27 and 32, disposed in threaded apertures 28 and 33. Partial cutaway details of the pivot clamping system is shown by FIG. 5. Conical pivot members 26A and 26B can be in the form of threaded set screws, in which case apertures 29 and 34 would be threaded to provide screwdriver-type adjustment for centering yoke 23.

Figure 3:
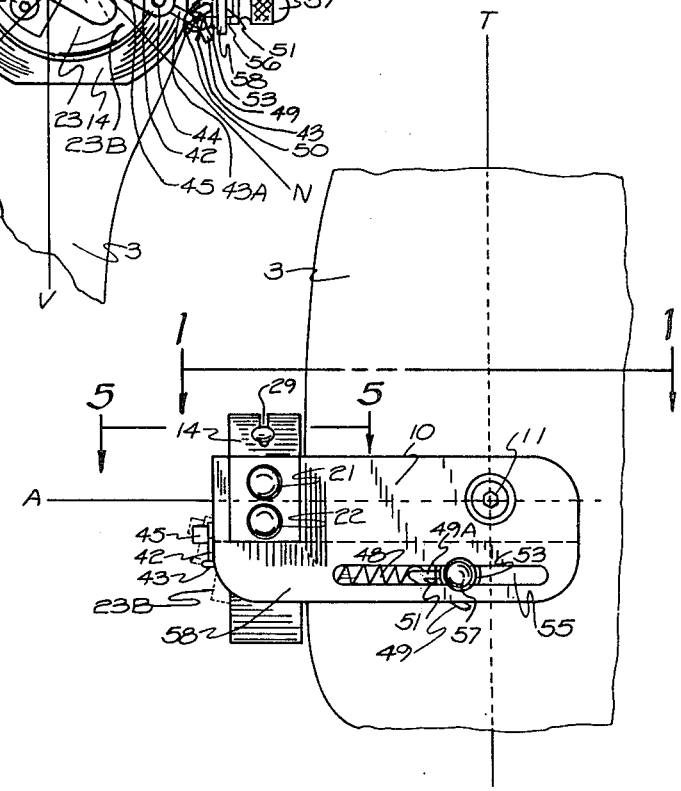
FIG. 3 is a fragmentary side elevational view taken along the line 3—3 of FIG. 1.

As depicted in FIGS. 2 and 6, pivot frame 14 is secured to bow 3 by satisfactory means such as mounting member 10 using suitable, laterally-adjustable means such as captive studs 15 and 16, shim plate 18, lock washers 21 and 22, thumb nuts 19 and 20, and shim-pack 17. Shim pack 17 is disposed on one or both sides of mounting member 10 to provide a means of lateral adjustment of pivot frame 14 without requiring a change in the length of captive studes 15 and 16. Mounting member 10 is secured to bow 3 by suitable means, such as screw 11 as depicted in FIGS. 1 and 3. Pivot frame member 14 and mounting member 10 can be adapted to use any of various securable telescoping spindle-or spline-type devices to provide lateral movement of pivot frame member 14 relative to the axis of intended arrow flight. The said spindle or spline can be a lead screw driven by satisfactory means, such as a captive indexing drum secured to mounting member 10.

Spring holder hook 43 is provided with a lateral portion 43A for insertion into stop block 42 through aperture 44B extending into aperture 44A and secured by suitable means, such as deforming the terminal and of 43A by punching through aperture 44A as shown in FIGS. 2 and 4.

Stop block 42 with spring holder hook 43 attached thereto is secured to yoke 23 by suitable means, such as screw 45 and threaded aperture 46 shown in FIGS. 2 and 4. Optional cushion pad 47 can be used to silence any clicking sound made when stop block 42 strikes pivot frame member 14 during the discharge of a shot.

A spring tension adjustment assembly comprising screw 54, spring-holder hook alignment plate 50 having aperture 52 disposed in guide flange 51 to accomodate shank portion 49A of spring holder hook 49, and washer 53 is assembled as shown in FIGS. 3 and 4. The spring tension adjustment assembly is securable anywhere along slot 55 disposed in flange 58 of mounting means 10. Guide flange 51 extends into slot 55 to act in combination with screw 54 to maintain satisfactory alignment of the spring tension adjustment assembly. One end of spring 48 is attached to yoke 23 by spring holder hook 43 carried by stop block 42; the other end of spring 43 is attached to mounting means 10 by adjustable spring holder hook 49. Flange 58 provides protection from physical damage for relatively fragile spring 48. The outer ends of spring holder hooks 43 and 49 protrude slightly beyond the edge of flange 58 to facilitate changing spring 48 without requiring the use of tools, as shown in FIG. 3. Wire-type spring holder hooks are used in this invention rather than traditional screws or studs in order to minimize the lateral torque that would be imposed on spring 48 by such screws or studs, thereby minimizing spring oscillation fatigue and objectionable noise generated by such oscillation.

The otherwise detrimental effect of slight changes in bearing friction is minimized by the design of the present invention by providing space within the framework of the device to allow for attachment of extensive-type spring 48 to yoke 23 about one inch away from pivot axis P. The leverage thus achieved permits the use of a relatively light spring tension to operate the yoke assembly, providing an added degree of forgiveness claimed for the device of this disclosure. Satisfactory spring loading of yoke 23 can be achieved by any type of spring system commonly used in rotatable devices which can be adapted to urge yoke 23 against a stop means. The extention-type spring system illustrated herein is used to provide generally constant spring tension during the alternating movement of yoke 23. An adjustable leaf, torque or compression spring system can be used to provide increasing tension as yoke 23 is moving away from the first stop means and decreasing tension as yoke 23 moves toward the first stop means. The spring system can be attached to or embodied in yoke 23, extending to pivot frame 14 or bow 3; or attached to, or embodied in, pivot frame 14 extending to yoke 23. A satisfactory counterweight system secured to yoke 23 can be used to supply decreasing resistance to movement as yoke 23 moves away from the first stop means upon impact of release, providing peak resistance when peak lateral displacement forces are imposed on the arrow-support means.

Bow 3 has a threaded aperture to receive screw 11 shown in FIGS. 1 and 3, provided in the manufacture of most modern bows and disposed at a point generally where the axis of intended arrow flight, indicated by line A of FIG. 3, and the axis of the torque center of the box handle cross, as depicted by lines A and T of FIG. 3. The outer end 35B of arrow support member 35 is disposed near the center of this aperture as shown by FIG. 1. The forward extending longitudinal axes of this invention are intended to be generally along lines parallel to the axis of intended arrow flight facilitating longitudinal alignment of the device in that the uppermost edge of mounting member 10, pivoting about screw 11, can be made parallel with the axis of an in-place arrow. Proper adjustment of arrow support member 38B is accomplished when the horizontal plane of the axis of an in-place arrow is aligned with the center of outer end 35B of arrow support member 35, shown in FIG. 2.

The embodiment of the invention illustrated herein uses a relatively large number of individual parts that in practice combine as a single functional part, such as the spring-holder hook adjustment assembly and the pivot frame-mounting means assembly.

Referring now to FIGS. 7 and 8, when arrow 2 absorbs the initial impact of the primary propelling force upon release of bowstring 4, the vertical displacement angle 5 and lateral displacement angle 6 will cause arrow 2 to start bending downwardly along net force line N of FIG. 9.

Referring now to FIGS. 1, 2, and 3, the present invention is used in place of supports 7 and 9 of FIGS. 7, 8, and 9. When the point end of arrow 2A exerts downwardly-directed force on the outer tips of arrow suport members 35 and 38, yoke 23 will rotate about pivot axis line P of FIG. 2, causing apex portion 23A of yoke 23 to move outwardly as indicated by 23B of FIG. 3, carrying stop block 42 (with spring member 48 attached thereto) away from pivot frame 14 and against the tension of spring 48, allowing arrow 2A to move downwardly along line N and across pivot axis P to a position 2B as indicated by phantom lines in FIGS. 1 and 2, conteracting most of the tendency of arrow **2*a* to bend. As arrow 2A proceeds out of bow 3**, it will recover from the effects of the vertical and lateral forces imposed on it by the impact of release. The tendency to bend downward will subside and the tension of spring 48 will return accelerating arrow 2A upwardly along net force line N until stop block 42 rests against pivot frame 14. Arrow 2A will proceed out of bow 3 to complete the discharge of the shot.

Referring now to FIG. 2, it is important to notice that the pivot axis, indicated by line P, passes through the horizontal plane of the longitudinal axis of arrow 2A, which is disposed along the axis of intended arrow flight, indicated by line A of FIG. 3. When arrow 2A is discharged from bow 3, downwardly-directed lateral forces cause the arrow shaft to exert a net downwardly-directed lateral force on the forward-protruding outer tips of the arrow support members, causing the arrow support-yoke assembly to pivot about the pivot axis line P between two stop means provided by stop block 42 and the bottoming-out of arrow support member 35. The mechanical strength of the present invention is great enough to require that portion of accelerating arrow 2A riding in the arrow-supporting portion of the yoke assembly to be disposed along line N. If arrow 2A moves to the position indicated by phantom arrow 2B, part of the circular cross-section of the arrow shaft can cross the pivot axis indicated by line P. Lateral interaction between the arrow-contacting portions of the arrow-supporting yoke assembly is minimized by the non-resilient nature of the device. Recess 23A, indicated in FIG. 4, provides means to allow arrow 2A to pass near or across the pivot axis line P to provide a relationship between arrow support members 35 and 38 and pivot axis P selected to minimize radial shifting of the arrow-supporting portions of the arrow support members 35 and 38 about the surface of accelerating arrow 2A during discharge of the shot. If under some shooting conditions interaction of the arrow support members is not considered objectionable, two or more resilient arrow support members can be used, provided that the combination is less resilient than spring 48.

When the tendency of accelerating arrow 2A to bend downwardly has subsided, the tension of spring 48 will return the arrow-supporting yoke assembly to the at-rest stop position, carrying accelerating arrow 2A back to the axis of intended arrow flight. This lifting of accelerating arrow 2A back to the axis of intended arrow flight occurs when the arrow shaft is straight and because there is no interaction between the arrow-supporting members, no additional lateral force is transmitted by the arrow support members to arrow 2A when stop block 42 comes to rest against pivot frame 14, minimizing overcompensation common with presently-used devices.

This would be considered an ideal shot with the present invention having counteracted most of the first tendency of the arrow shaft to bend, allowing the arrow to proceed out of the bow with little or no S curve. If on the next shot the archer produces an inconsistent release, causing more lateral displacement than vertical displacement and a net force which is different from the first shot, the present invention will react exactly as described previously, pivoting an axis line P and thereby applying counteractive force to the accelerating arrow to follow line N. This counteractive force is opposed to the different net line of force and is derived from the non-variable plane of line N and is added to the different net line of force, resulting in a net line of force closer to line N. When the arrow has lost its tendency to bend along the different net force line, the energy stored in spring 48 will return the arrow shaft upwardly along line N until stop block 42 again rests against pivot frame 14, effectively counteracting a change in lateral displacement force. The yoke will react in the same way to a change in vertical displacement force.

When using the yoke arrow support, the bending of the arrow generally does not transmit appreciable lateral energy to the bowhandle, the tension of spring 48 being the maximum pressure the arrow can transfer back to the bow. Under these conditions, during the time the energy stored in the bow limbs is being transmitted to the arrow through the bow string, the bow-arrow unit displays a gyro-effect as long as the arrow is accelerating. This gyro-effect maintains the bow vertically stable as long as the arrow is absorbing energy from the bow. If the archer has heeled his bow, the effect of this heeling—which kicks the lower limb forward, effectively lowering the nocking point—will generally not occur until near the end of the power stroke of the bow, when the gyro-effect subsides. At this time, the arrow will be affected as though the nocking point were suddenly lowered, causing the arrow support to pivot downwardly along line N, counteracting to a large degree the effects of severe heeling of the bow.

It is the combination of mechanical parts capable of providing this action for which I seek Letters Patent as set forth in the following claims.

I claim:

1. An arrow support assembly for counteracting the vertical and horizontal forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly comprising, in combination, the following:

a. pivot frame means for rigidly connecting to said handle section of said archery bow, b. yoke member means pivotally connected to said pivot frame means, all of said yoke member means pivoting in response to the forces imposed on an arrow being shot from a bow, said yoke member means having connected thereto, and extending in the direction of intended arrow flight, at least two, spaced apart, elongated, substantially non-resilient means for engaging and supporting an arrow along a substantial length of an arrow, and c. resilient means for biasing in unison said yoke member means and said means for supporting an arrow toward a predetermined neutral position as an arrow is being shot from an archery bow to counteract the vertical and horizontal forces imposed on said arrow as said arrow is being shot from said archery bow.

2. The arrow support assembly of claim 1 wherein said yoke member means is pivotally connected to said pivot frame means by pivot pin means for permitting said yoke member means to pivot within said pivot frame means, said pivot pin means being positioned so that an arrow being shot from an archery bow will cause said means for supporting an arrow to move downwardly and horizontally when the longitudinal axis of an archery bow is positioned vertical.

* * * * *